340-566 SR
8/15/78 XR 4,107,545

United States Patent [19]
Gittelis

[11] 4,107,545
[45] Aug. 15, 1978

[54] MOUNTING CONSTRUCTION FOR MOTION SENSOR

[75] Inventor: Meir Gittelis, Moshav Bnei Atarot, Israel

[73] Assignee: Nahshol Electronics Ltd., Moshav Bnei Atarot, Israel

[21] Appl. No.: 829,184

[22] Filed: Aug. 30, 1977

[30] Foreign Application Priority Data

Aug. 31, 1976 [IL] Israel ..... 50389

[51] Int. Cl.[2] ..... H01H 35/14
[52] U.S. Cl. ..... 307/121; 200/61.45 R; 340/566
[58] Field of Search ..... 307/121; 200/61.45 M, 200/DIG. 29, 61.45 R; 340/261, 262, 282

[56] References Cited

U.S. PATENT DOCUMENTS 4,001,185 1/1977 Mitsui et al. ..... 200/61.45 R

*Primary Examiner*—Herman J. Hohauser
*Attorney, Agent, or Firm*—Browdy and Neimark

[57] ABSTRACT

A force sensor comprising an array of three conductive points respectively insulated from one another; a movable conductive element normally resting in contact with the points and thus producing an electrical interconnection therebetween and displaceable out of contact with at least one of the points in response to the application of a predetermined force to the sensor; means for connecting the three points to logic circuitry for sensing the interruption of the electrical interconnection and determining in response thereto whether an alarm condition exists; a housing containing the three point array and the movable conductive elements and having an outer configuration which includes a spherical portion; means fixedly mountable onto an article and defining a socket surface complementary to the spherical portion; and clamp means for selectably attaching the housing to the mounting means and permitting ready adjustment of the orientation of the spherical portion with respect to the complementary socket portion with two degrees of freedom to enable precise angular orientation of the sensor with respect to the article.

4 Claims, 3 Drawing Figures

MOUNTING CONSTRUCTION FOR MOTION SENSOR

FIELD OF THE INVENTION

The present invention relates to sensing apparatus, for example apparatus which is mounted onto articles for monitoring the motion thereof. Such sensors are employed widely in security installations for guarding against entry onto or contact with certain premises.

BACKGROUND OF THE INVENTION

Apparatus is known, comprising a three point conductive mount and a conductive ball resting thereon, for detecting acceleration which is above a predetermined minimum limit such that it causes the ball to temporarily break contact with one of the three conductive points. Logic circuitry is provided for determining when such a temporary break in contact indicates a true alarm.

Sensor devices of the type described hereinabove suffer from a number of disadvantages. Primary among these is the extreme difficulty of properly aligning the sensor when mounting the same on a given article. It is appreciated that improper alignment of the sensor can greatly affect its sensitivity, causing the conductive ball to break contact between respective points of the three point contact in response to either too little or too great of a force. Furthermore the overall construction of conventional sensors of the type described hereinabove is relatively cumbersome which results in a relatively high manufacturing cost.

SUMMARY OF THE INVENTION

The present invention seeks to overcome the disadvantages of prior art constructions for sensors comprising the following elements:

three conductive points respectively insulated from one another;

a movable conductive element normally resting in contact with said points and thus producing an electrical interconnection therebetween and being displaceable out of contact with at least one of said points in response to the application of a predetermined force; and means for connecting said three points to logic circuitry for sensing interruption of said electrical interconnection and determining in response thereto whether an alarm condition exists.

The above apparatus will hereinafter be referred to as a sensor of the type specified.

The present invention thus provides mounting means for a sensor of the type specified comprising:

a housing containing said sensor and having an outer configuration which includes a spherical portion;

means fixedly mountable onto an article and defining a socket surface complementary to said spherical portion; and clamp means for selectably attaching said housing to said mounting means and permitting ready adjustment of the orientation of said spherical portion with respect to said complementary socket portion with two degrees of freedom to enable precise angular orientation of said sensor with respect to said article.

In accordance with a preferred embodiment of the invention said housing comprises:

a spherical portion separated into first and second generally hemispherical parts;

cable access conduits communicating with at least one side of at least one hemispherical part;

means for joining said respective hemispherical parts to form a sealed housing; and means for containing at least one movable conductive element and means for mounting said three points for operative association with said movable conductive element.

In accordance with an embodiment of the invention the cable access conduits are formed at respective opposite sides of said respective hemispherical parts and ring seal members are disposed surrounding said cables in respective half-disc recesses defined adjacent said respective hemispheres in said cable conduits.

There is thus provided in accordance with an embodiment of the invention a force sensor comprising:

an array of three conductive points respectively insulated from one another;

a movable conductive element normally resting in contact with said points and thus producing an electrical interconnection therebetween and displaceable out of contact with at least one of said points in response to the application of a predetermined force to said sensor;

means for connecting said three points to logic circuitry for sensing the interruption of said electrical interconnection and determining in response thereto whether an alarm condition exists;

a housing containing said three point array and said movable conductive elements and having an outer configuration which includes a spherical portion;

means fixedly mountable onto an article and defining a socket surface complementary to said spherical portion; and clamp means for selectably attaching said housing to said mounting means and permitting ready adjustment of the orientation of said spherical portion with respect to said complementary socket portion with two degrees of freedom to enable precise angular orientation of said sensor with respect to said article.

BRIEF DESCRIPTION OF THE DRAWINGS

The invention will be more fully understood and appreciated from the following detailed description taken in conjunction with the drawing in which.

DETAILED DESCRIPTION OF A PREFERRED EMBODIMENT

Figure 2:
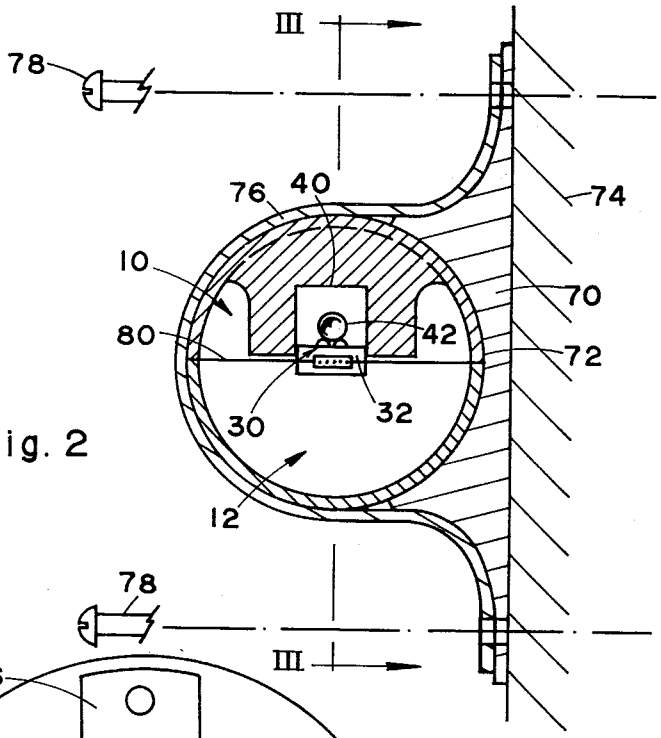
FIG. 2 is a sectional view of the sensor of FIG. 1 mounted onto an article.
Figure 3:
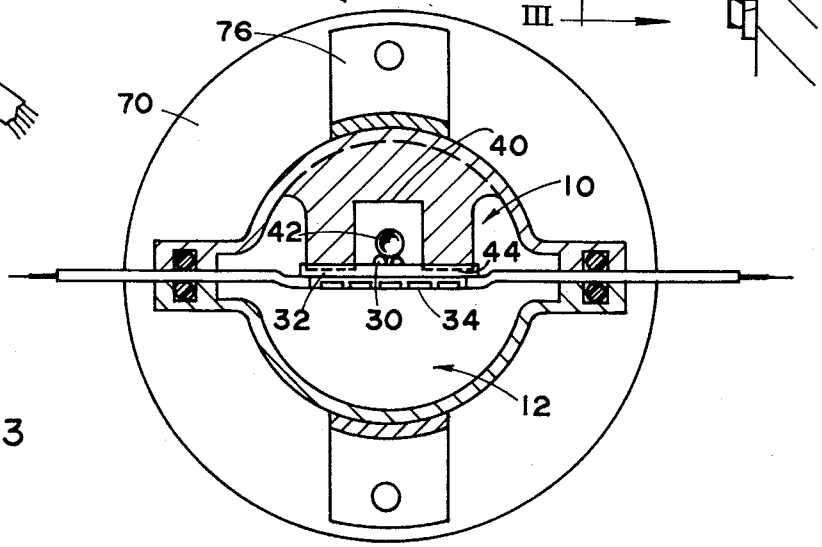
FIG. 3 is a sectional view of the sensor of FIGS. 1 and 2 taken along the line III—III of FIG. 2.
Figure 1:
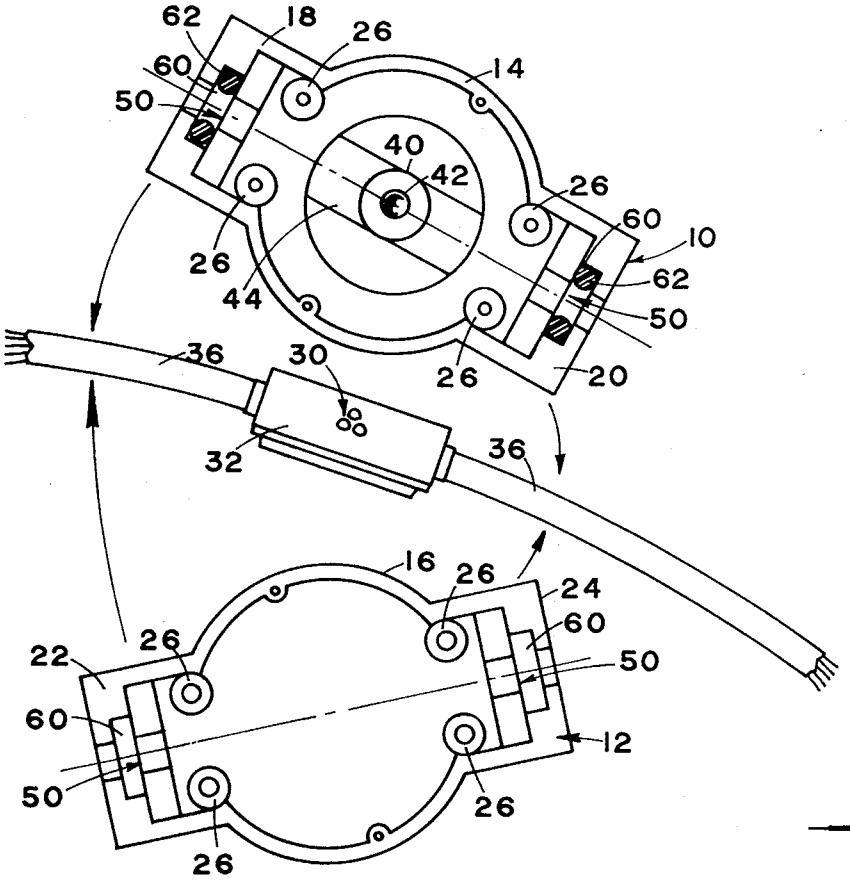
FIG. 1 is a pictorial illustration of a sensor constructed and operative in accordance with an embodiment of the invention.

Referring now to FIGS. 1–3 there is seen a sensor constructed and operative in accordance with a preferred embodiment of the invention comprising a housing formed in two complementary parts 10 and 12. Part 10 comprises generally hemispherical portion 14 and conduit portions 18 and 20 communicating with the interior thereof. Similarly part 12 comprises a hemispherical portion 16 complementary to portion 14 and conduit portions 22 and 24 which are complementary to respective conduit portions 18 and 20.

The exterior configurations of respective parts 10 and 12 are substantially identical and the two parts may be joined by screws (not shown) passing through respective sockets 26 to form a sealed housing having a generally spherical centre portion and two generally cylindrical oppositely disposed conduit portions.

An array 30 of three conductive spaced points is mounted on a supporting member such as a miniature circuit board 32. The conductive points are normally defined of generally spherical or pointed metallic elements and are normally electrically insulated from one another. The points in array 30 are connected to external logic circuitry (not shown) via circuitry and connectors such as printed circuitry 34 formed on the underside of circuit board 32 which is coupled to multi-conductor electrical cables 36. Cables 36 may be of any suitable construction and design and the electrical connection thereof to circuit board 32 may be effected in any desired way.

Part 10 which is normally disposed for operation above part 12, is formed with a generally cylindrical recess 40 in which is disposed a conductive ball 42 typically formed of metal such as brass.

Means are provided for securely attaching conductive point array 30 to part 10 such that array 30 underlies recess 40 in a position whereby ball 42 may rest by virtue of gravitational force on the three point array and may be temporarily or permanently removed therefrom in response to application of a suitable force. Such means may comprise a channel 44 defined within part 10 and adapted to receive circuit board 32 in a press fit arrangement. Alternatively or additionally fastening means such as bolts and complementary sockets may be provided for securely removably attaching the three point conductive array to part 10.

Cable 36 is arranged to be disposed along channels formed in the respective conduit portions and indicated generally by reference numeral 50. It is noted that the conduit portions are formed with respective complementary half-disc recesses 60 arranged to receive O-rings 62 which engage cable 36 and provide a tight seal between the interior of the assembled housing and exterior thereof for sealing against various elements such as dust and humidity.

As seen in FIGS. 2 and 3 a mounting socket 70 having a generally spherically curved recess 72 complementary to the outside configuration of respective joined spherical portions 14 and 16 is provided for mounting of the housing comprising parts 10 and 12 onto an article 74 such as a wall, post or vehicle. Socket 70 may be conveniently molded from a plastics material.

A clamp member 76 having an inner curved configuration generally complementary with the curvature of the sphere defined by portions 14 and 16 is provided for association with socket 70 and parts 10 and 12.

Mounting of the sensor described hereinabove is effected as follows: The socket 70 and clamp 76 are together mounted onto an article 74 typically by means of screws 78. Socket 70 may lie in any desired orientation and need not be vertically mounted. The assembled sensor comprising joined portions 10 and 12 is then engaged with socket 70 in a generally horizontal orientation such that the plane 80 defined by the junction of parts 10 and 12 lies level and perpendicular to the axis of gravitational force. The initial attachment of clamp 76 is sufficiently loose so as to permit rotation of parts 10 and 12 with respect to socket 70. Final adjustment of the level orientation of the sensor is then performed using suitable instrumentation and clamp 76 is then tightened to prevent further relative rotation between socket 70 and the sensor.

It is appreciated that the sensor and associated mounting apparatus constructed and operative in accordance with the present invention and described hereinabove enable relatively easy, quick, precise and level orientation of the sensor which is essential to permit accurate functioning thereof such that disengagement of ball 42 from one or more of the conductive points of array 30 occurs at a desired level of applied force.

It will be appreciated by persons skilled in the art that many variations in the apparatus shown and described hereinabove with respect to the drawings may occur. For example a plurality of respective points arrays and corresponding conductive balls may be incorporated in either series or parallel connection within a single sensor. Therefore the invention is limited only by the claims which follow.

I claim:

1. Mounting means for a sensor including three conductive points respectively insulated from one another;

a movable conductive element normally resting in contact with said points and thus producing an electrical interconnection therebetween and being displaceable out of contact with at least one of said points in response to the application of a predetermined force; and means for connecting said three points to logic circuitry for sensing interruption of said electrical interconnection and determining in response thereto whether an alarm condition exists; said mounting means comprising:

a housing containing said sensor and having an outer configuration which includes a spherical portion;

means fixedly mountable onto an article and defining a socket surface complementary to said spherical portion; and clamp means for selectably attaching said housing to said mounting means and permitting ready adjustment of the orientation of said spherical portion with respect to said complementary socket portion with two degrees of freedom to enable precise angular orientation of said sensor with respect to said article.

2. Apparatus according to claim 1 wherein said housing comprises:

a spherical portion separated into first and second generally hemispherical parts;

cable access conduits communicating with at least one side of at least one hemisphere;

means for joining said respective hemispherical parts to form a sealed housing; and means for containing at least one movable conductive element and means for mounting said three points for operative association with said movable conductive element.

3. Apparatus according to claim 2 wherein said cable access conduits are formed at respective opposite sides of said respective hemispherical parts and ring seal members are disposed surrounding said cables in respective half-disc recesses defined adjacent said respective hemispheres in said cable conduits.

4. Apparatus according to claim 1 wherein said means for connecting said three points to said logic circuitry comprises printed circuit means.

* * * * *